US006068532A

United States Patent [19]

Lai et al.

[11] Patent Number: 6,068,532

[45] Date of Patent: May 30, 2000

[54] METHOD FOR FABRICATING VACUUM DISPLAY DEVICES AND STRUCTURES FABRICATED

[75] Inventors: Jiun-Tsuen Lai, Changhua; Mark Lin, Hsinchu; Cheng-Chung Lee, Hsinchu, all of Taiwan

[73] Assignee: Industrial Technology Research Institute, Hsinchu, Taiwan

[21] Appl. No.: 09/358,100

[22] Filed: Jul. 21, 1999

[51] Int. Cl.[7] ..... H01J 9/24

[52] U.S. Cl. ..... 445/24

[58] Field of Search ..... 445/24

[56] References Cited

U.S. PATENT DOCUMENTS 5,717,287 2/1998 Amrine et al. ..... 445/24

5,980,346 11/1999 Anderson et al. ..... 445/24

*Primary Examiner*—Kenneth J. Ramsey

*Attorney, Agent, or Firm*—Tung & Associates

[57] ABSTRACT

A method for forming a vacuum display device elongated spacers therein and devices formed by such method are disclosed. In the method, a number of elongated spacers are first mounted in a clamping fixture such that the bottom edges of the spacers extends perpendicularly away from the clamping fixture and are sufficiently exposed. The clamping fixture with the elongated spacers are then pushed onto a substrate that is coated with a layer of adhesive material. After the bottom edges of the spacers are adequately coated with a layer of adhesive material, the clamping fixture is removed from the layer of adhesive and then pushed onto a lower glass panel of the vacuum display device with the spacers contacting spacings provided between active regions on the top surface of the lower glass plate. The completed structure may optionally be subjected to an annealing process at a temperature between about 250° C. and about 600° C. to improve the bond strength and to relieve the bonding stress. After the spacers are adequately bonded to the lower glass panel, the clamping fixture is removed and a top glass plate is bonded to the top edges of the spacers and four sidewall panels positioned at the peripheral areas of the vacuum display device to form a vacuum-tight chamber.

24 Claims, 4 Drawing Sheets

METHOD FOR FABRICATING VACUUM DISPLAY DEVICES AND STRUCTURES FABRICATED

FIELD OF THE INVENTION

The present invention generally relates to a method for fabricating vacuum display devices and structures fabricated and more particularly, relates to a method for fabricating vacuum display devices by utilizing elongated spacers that have high height/width aspect ratios and vacuum display devices fabricated by using such elongated spacers.

BACKGROUND OF THE INVENTION

In recent years, flat panel display devices have been developed and widely used in electronic applications such as personal computers. One of the popularly used flat panel display device is an active matrix liquid crystal display which provides improved resolution. However, the liquid crystal display device has many inherent limitations that render it unsuitable for a number of applications. For instance, liquid crystal displays have numerous fabrication limitations including a slow deposition process for coating a glass panel with amorphous silicon, high manufacturing complexity and low yield for the fabrication process. Moreover, the liquid crystal display devices require a fluorescent backlight which draws high power while most of the light generated is wasted. A liquid crystal display image is also difficult to see under bright light conditions or at wide viewing angles which further limit its use in many applications.

Other flat panel display devices have been developed in recent years to replace the liquid crystal display panels. One of such devices is a field emission display (FED) device that overcomes some of the limitations of LCD and provides significant advantages over the traditional LCD devices. For instance, the field emission display devices have higher contrast ratio, larger viewing angle, higher maximum brightness, lower power consumption and a wider operating temperature range when compared to a conventional thin film transistor (TFT) liquid crystal display panel.

One of the most drastic difference between a FED and a LCD is that, unlike the LCD, FED produces its own light source utilizing colored phosphors. The FEDs do not require complicated, power-consuming backlights and filters and as a result, almost all the light generated by a FED is visible to the user. Furthermore, the FEDs do not require large arrays of thin film transistors, and thus, a major source of high cost and yield problems for active matrix LCDs is eliminated.

In a FED, electrons are emitted from a cathode and impinge on phosphors on the back of a transparent cover plate to produce an image. Such a cathodoluminescent process is known as one of the most efficient methods for generating light. Contrary to a conventional CRT device, each pixel or emission unit in a FED has its own electron source, i.e., typically an array of emitting microtips. A voltage difference existed between a cathode and a gate extracts electrons from the cathode and accelerates them toward the phosphor coating. The emission current, and thus the display brightness, is strongly dependent on the work function of the emitting material. To achieve the necessary efficiency of a FED, the cleanliness and uniformity of the emitter source material are therefore very important.

In order for the electron to travel in a FED, most FEDs are evacuated to a low pressure, such as $10^{-7}$ torr, in order to provide a log mean free path for the emitted electrons and for preventing contamination and deterioration of the microtips. The resolution of the display can be improved by using a focus grid to collimate the electrons drawn from the microtips.

In the early development for field emission cathodes, a metal microtip emitter of molybdenum was utilized. In such a device, a silicon wafer is first oxidized to produce a thick silicon oxide layer and then a metallic gate layer is deposited on top of the oxide. The metallic gate layer is then patterned to form gate openings, while subsequent etching of the silicon oxide underneath the openings undercuts the gate and creates a well. A sacrificial material layer such as aluminum is deposited to prevent deposition of molybdenum into the emitter well. Molybdenum is then deposited at normal incidence such that a cone with a sharp point grows inside the cavity until the opening closes thereabove. An emitter cone is left when the sacrificial layer of aluminum is removed.

In an alternate design, silicon microtip emitters are produced by first conducting a thermal oxidation on silicon and then followed by patterning the oxide and selectively etching to form silicon chips. Further oxidation or etching protects the silicon and sharpens the point to provide a sacrificial layer. In another alternate design, the microtips are built onto a substrate of a desirable material such as glass, as an ideal substrate for large area flat panel display. The microtips can be formed of conducting materials such as metals or doped semi-conducting materials. In this alternate design for a FED device, an interlayer that has controlled conductivity deposited between the cathode and the microchips is highly desirable. A proper resistivity of the interlayer enables the device to operate in a stable condition. In fabricating such FED devices, it is therefore desirable to deposit an amorphous silicon film which has electrical conductivity in an intermediate range between that of intrinsic amorphous silicon and $n^+$ doped amorphous silicon. The conductivity of the $n^+$ doped amorphous silicon can be controlled by adjusting the amount of phosphorous atoms contained in the film.

Generally, in the fabrication of a FED device, the device is contained in a cavity of very low pressure such that the emission of electrons is not impeded. For instance, a low pressure of $10^{-7}$ torr is normally required. In order to prevent the collapse of two relatively large glass panels which form the FED device, spacers must be used to support and provide proper spacing between the two panels. For instance, in conventional FED devices, glass spheres have been used for maintaining such spacings in FED devices. For high anode voltage FED devices, elongated spacers have also been used for such purpose as shown in FIGS. 1A and 1B.

FIG. 1A is a perspective, partially exploded view of a conventional FED device 10. The FED device 10 is constructed by an upper glass plate 12 and a lower glass plate 14. In-between the two glass plates 12, 14, a plurality of elongated spacers 20 are utilized to support the spacing between the two plates under high vacuum pressure. The plurality of spacers 20 are held in place, i.e., positioned between active regions 16 formed on the surface 22 of the bottom glass plate 14. The plurality of elongated spacers 20 are held in place by slots 24 provided in sidewall panels 18, as shown in FIG. 1A and in an enlarged top view of FIG. 1B.

The conventional method for mounting the plurality of spacers 20, shown in FIGS. 1A and 1B, presents a number of processing difficulties. First, since the elongated spacers are not held in place at its center, the center portion of the spacer may easily be displaced from its correct position on the bottom glass plate. Furthermore, the elongated spacers

20 must be provided with vacuum passageways such that vacuum may be withdrawn in the cavity. Thirdly, slots at precise locations must be provided in the sidewall panels 18 which further complicates the fabrication process for the FED device.

In modem FED devices, higher operating voltages are frequently needed in order to achieve improved resolution and brightness of the device. For instance, a high voltage of several thousand volts is frequently employed as the driving voltage for the FED. At such high voltages, the spacing (0.5~5 mm) between the upper glass plate and the lower glass plate must be sufficiently maintained in order to avoid electrical discharges from occurring between the plates. The proper spacing in a FED cavity is therefore a more critical issue in high voltage FED devices.

It is therefore an object of the present invention to provide a method for forming a vacuum display device that does not have the drawbacks or shortcomings of the conventional methods.

It is another object of the present invention to provide a method for forming a vacuum display device such that the device can stand up to a high vacuum pressure without collapsing.

It is a further object of the present invention to provide a method for forming a vacuum display device designed for high operating voltage without incurring electrical discharge problems in the cavity.

It is another further object of the present invention to provide a method for forming a vacuum display device that has a spacing between two glass plates as large as 5 mm.

It is still another object of the present invention to provide a method for forming a vacuum display device by utilizing elongated spacers for maintaining the spacing between two parallely positioned glass plates.

It is yet another object of the present invention to provide a method for forming a vacuum display device by utilizing elongated spacers that are glued at a bottom edge to the lower glass plate.

It is still another further object of the present invention to provide a method for forming a field emission display device by utilizing elongated spacers which are mounted to a lower glass plate by utilizing a holding fixture to coat the bottom edges of the spacers with an adhesive.

It is yet another further object of the present invention to provide a method for fabricating a field emission display device utilizing elongated spacers by first clamping the spacers in a holding fixture and then coating the bottom edges of the spacers with a layer of adhesive previously deposited on a substrate by a screen printing or other coating methods.

SUMMARY OF THE INVENTION

In accordance with the present invention, a method for fabricating a vacuum display device incorporating elongated spacers therein and device fabricated are provided.

In a preferred embodiment, a method for forming a vacuum chamber can be carried out by the operating steps of first providing an upper glass panel and a lower glass panel, providing spacers in elongated shape with their upper ends removably clamped in a clamping fixture such that each of the spacers extends perpendicularly away from the clamping fixture at a predetermined distance from its immediately adjacent spacers, pressing the clamping fixture into and removing the same from a layer of adhesive such that the lower end of each of the spacers are coated with the adhesive, pressing the clamping fixture onto a top surface of the lower glass panel such that each of the lower ends of the spacers intimately contacts the top surface of the lower glass panel, heating the clamping device, the spacers and the lower glass panel to a temperature and for a time period sufficient to form an adhesive bond between the lower ends of the spacers and the top surface of the lower glass panel, removing the clamping fixture from the upper ends of the spacers, and mounting the upper glass panel to the upper ends of the spacers.

In the method for forming a vacuum chamber, the spacers may be provided in elongated shape which has an aspect ratio of width/height of at least ⅕, or between about ⅕ and about 1/20. The method may further include the step of heating the clamping device, the at least two spacers and the lower glass panel to a temperature of at least 250° C. or between about 250° C. and about 600° C. The lower glass panel may be provided with active regions that have a predetermined space thereinbetween for the mounting of the at least two spacers. The method may further include the step of bonding the upper glass panel to the upper ends of the spacers, or mounting the upper glass panel to the spacers and four sidewall panels between the upper and lower glass panels to form a sealed chamber.

In another preferred embodiment, a method for fabricating a vacuum display device with spacers between active regions can be carried out by the operating steps of providing a first glass panel which has a multiplicity of active regions formed on a top surface, the multiplicity of active regions are generally arranged in a spaced-apart, matrix configuration that has pre-set spacings thereinbetween, providing a plurality of spacers in elongated shape each has a top edge and a bottom edge parallel to the top edge, mounting the plurality of spacers in a holding fixture with the top edges of the spacers releasably clamped in the fixture and the bottom edges substantially exposed, pressing the holding fixture with the plurality of spacers clamped therein against a layer of adhesive until the bottom edges of the spacers are coated with the adhesive, pressing the holding fixture onto the top surface of the first glass panel until the bottom edges of the spacers are bonded to the top surface in the pre-set spacings and removing the holding fixture, and mounting a second glass panel onto the bottom edges of the plurality of spacers forming a vacuum display device.

The method for fabricating a vacuum display device with spacers between active regions may further include the step of providing the layer of adhesive in a dielectric material, or providing the layer of adhesive in an electrically insulating material that stands up to a service temperature of 500° C., or providing the layer of adhesive in a material selected from the group consisting of oxide pastes and glass fritz. The method may further include the step of providing the layer of adhesive material by a screen printing technique in a pattern corresponding to a pattern of placement of the plurality of spacers. The method may further include the step of providing the layer of adhesive material by a spin coating technique until a pre-set thickness of the adhesive is achieved.

In the method for fabricating a vacuum display device with spacers positioned between active regions, the holding fixture utilized may be a mechanical clamping device. The method may further include the step of providing a first glass panel that has a multiplicity of pixels formed thereon, the multiplicity of pixels are electrically insulated from each other in a spaced-apart relationship with a pre-set spacing thereinbetween. The pre-set spacing may be in the range of between about 50 μm and about 200 μm. The layer of adhesive may have a sufficient thickness such that the bottom edges of the spacers are coated with the adhesive to a thickness between about 5 μm and about 20 μm. The plurality of spacers may have a height/width aspect ratio of between about ⅕and about 1/20. The plurality of spacers may have a height between about 0.5 mm and about 5 mm. The method may further include the step of heating the holding fixture, the plurality of spacers and the first glass panel to a temperature sufficient to form a bond between the bottom edges of the plurality of spacers and the top surface of the first glass panel. The method may further include the step of heating the holding fixture, the plurality of spacers and the first panel to a temperature of at least 250° C., or in the range between about 250° C. and about 600° C. The method may further include the step of bonding a second glass panel onto the bottom edges of the plurality of spacers and four sidewall panels forming a vacuum tight chamber.

BRIEF DESCRIPTION OF THE DRAWINGS

These and other objects, features and advantages of the present invention will become apparent from the following detailed description and the appended drawings in which.

Detailed Description of the Preferred Embodiment

The present invention discloses a method for forming a vacuum display device that does not have the drawbacks or shortcomings of the conventional method by utilizing elongated spacers which can be advantageously bonded to a lower glass panel of the device without complicated processing steps. The present invention novel method of bonding elongated spacers in a vacuum display device can be suitably used in forming any flat panel device that utilizes vacuum in the device to prevent possible collapse of the panels, while especially suitable in forming high voltage type vacuum display devices wherein the spacing between two glass panels are increased in order to prevent undesirable electrical discharges from occurring in the spacing.

The elongated spacer utilized in the present invention method can be advantageously bonded to a lower glass panel at spacings provided between the active regions, or the electron emission areas, by a simple and reliable method. The present invention elongated spacers can achieve a larger spacing required in modem vacuum display devices in which glass spheres are no longer adequate to provide such large spacing. Furthermore, in utilizing the present invention novel method for bonding the elongated spacers, there is no need to provide slots in the sidewalls of the display device such that the fabrication process for the device can be more simply executed resulting in a structure of high reliability.

Figure 1A:
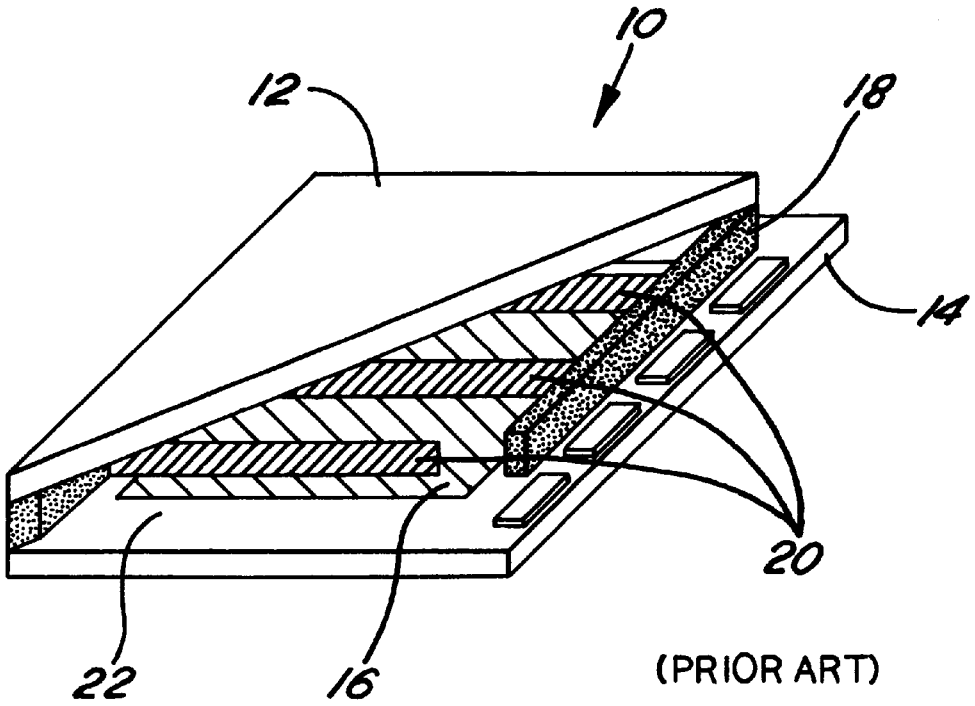
(PRIOR ART) FIG. 1A
FIG. 1A is a partially exploded, perspective view of a conventional flat panel display device utilizing spacers therein.
Figure 1B:
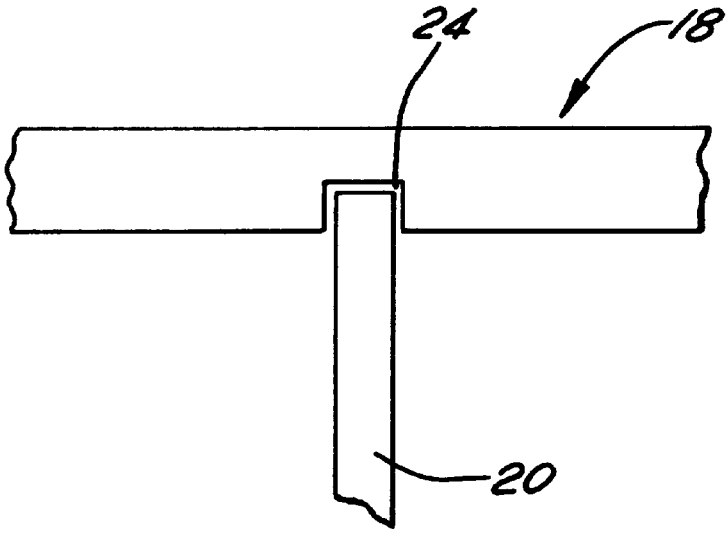
(PRIOR ART) FIG. 1B
FIG. 1B is an enlarged, partial, plane view of the structure shown in FIG. 1A illustrating the engagement of a spacer with a slot provided in the sidewall panel.
Figure 2A:
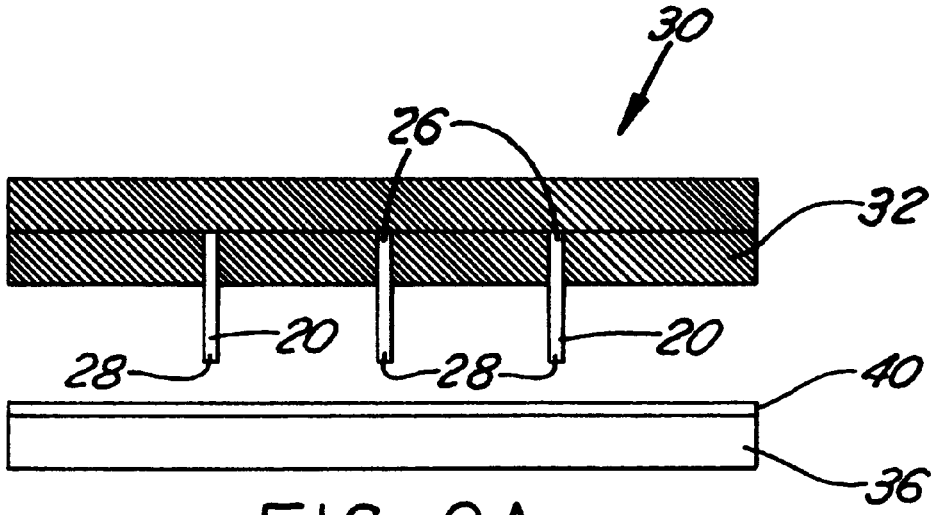
FIG. 2A is a cross-sectional view of the present invention method showing spacers being held in a holding fixture positioned over a layer of adhesive material.

Referring now to FIG. 2A, wherein a present invention holding fixture 30 including a plurality of clamping plates 32 for clamping a plurality of spacers 20 thereinbetween is shown. The clamping plates 32 can be easily operated by mechanical means such as springs and bolts for applying pressure on the spacers 20 and for holding them securely in place. The clamping plates 32 hold the top edges 26 of the spacers 20 and leave the bottom edges 28 sufficiently exposed. Also shown in FIG. 2A is a layer of adhesive 40 coated on a substrate 36.

In the present invention novel method, the adhesive layer 40 applied on the substrate 36 can be suitably a high temperature adhesive material such as an oxide paste or a glass fritz. The adhesive should survive a high annealing temperature of at least 250° C., or as high as 600° C. that is frequently used in a subsequent annealing process for the adhesive bond formed between the spacers and the glass plate. The adhesive material in layer 40 should have a suitable viscosity, i.e., in the range between about 10,000 cps and about 1,000,000 cps at a shear rate of 1.0 l/sec such that the adhesive is viscous enough to be applied by either a screen printing method or a spin coating method, while fluid enough for wetting the bottom ends of the spacers upon contact.

The layer of adhesive 40 can be suitably applied to the surface of the substrate 36 by a screen printing method in a pattern that corresponds to a pattern of the spacers mounted on the glass plate. In other words, only selective areas on top of the substrate 36 need to be covered by the adhesive. The adhesive layer 40 may further be applied by a spin coating method to evenly cover the surface of the substrate 36. The shelf life of the adhesive material is also important so that the layer of adhesive may be used for a large number of assembling applications.

Figure 2B:
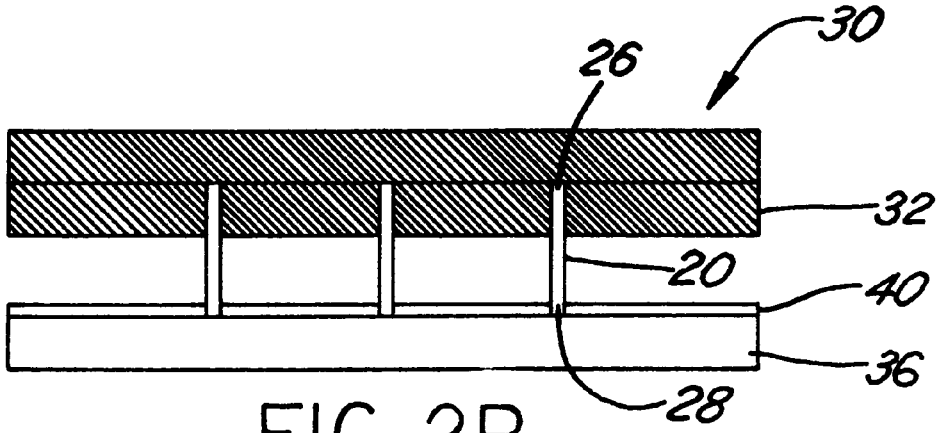
FIG. 2B is a cross-sectional view of the present invention spacers shown in FIG. 2A with the lower ends of the spacers dipped in an adhesive layer.

FIG. 2B is a cross-sectional view of the present invention structure shown in FIG. 2A with the holding fixture 30 pressed into the adhesive layer 40 such that the bottom edges 28 of the spacers 20 are immersed, or in contact with the adhesive layer 40. The pressure used for pressing the holding fixture 30 into the substrate 36 should be high enough such that adequate contact is established between the bottom ends 28 of the spacers 20 and the adhesive layer 40, yet low enough such that any breakage or dislocation of the spacers 20 can be avoided.

Figure 2C:
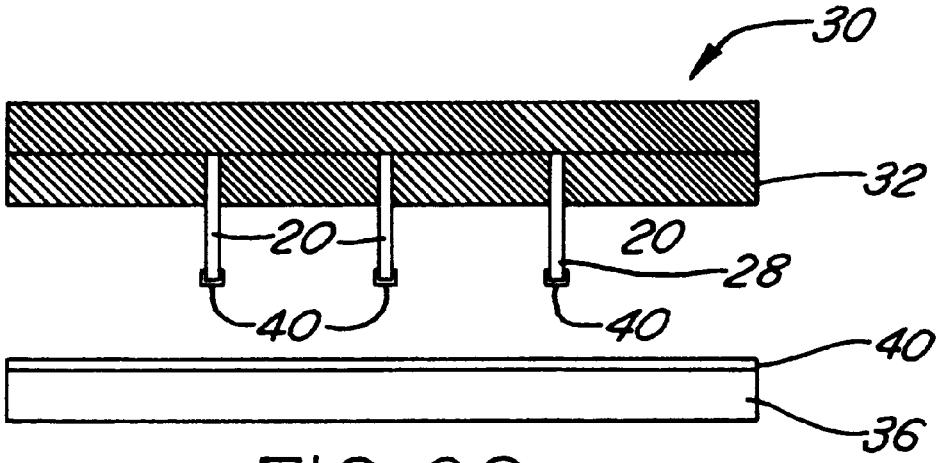
FIG. 2C is a cross-sectional view of the present invention spacer of FIG. 2B after contacting with an adhesive layer and removed from such layer.

After the bottom ends 28 of the spacers 20 are adequately dipped into the coating layer 40, the holding fixture 30 is moved upwardly from the coating layer 40 such that the bottom ends 28 of the spacers 20 are adequately coated with the adhesive material 40, as shown in FIG. 2C. It should be noted that the amount of coating of the adhesive material 40 on the bottom ends 28 is a function of the adhesive properties, such as the viscosity of the adhesive. The coating layer 40 of adhesive on the bottom ends 28 should have a thickness between about 5 μm and about 40 82 m so that the spacers can be bonded to a glass substrate without contaminating the active regions. This is shown in FIG. 2D, 2E and 2F.

Figure 2D:
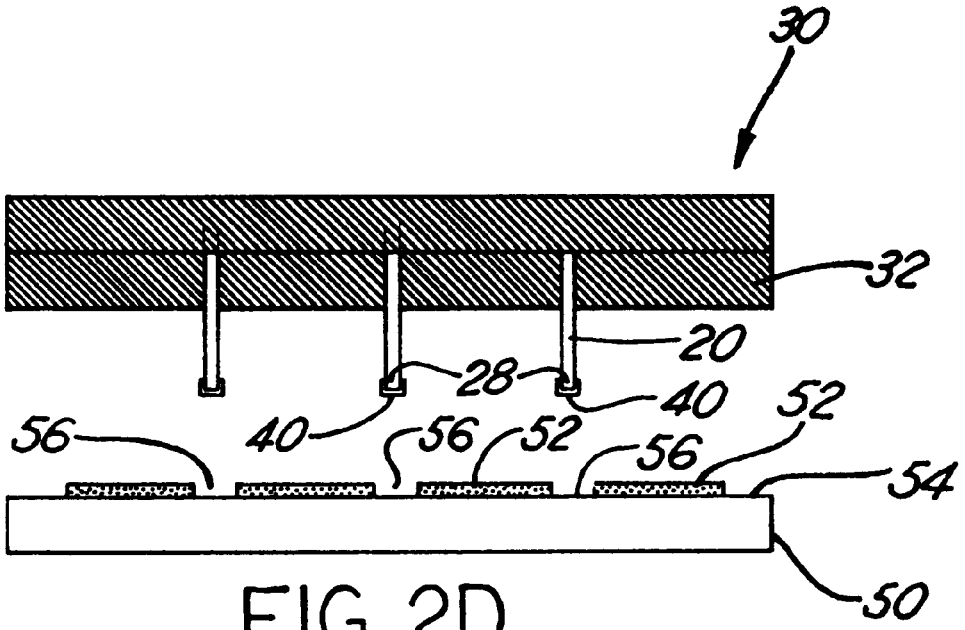
FIG. 2D is a cross-sectional view of the present invention spacer of FIG. 2C with the ends of the spacer coated with an adhesive layer and positioned over a lower glass panel formed with active regions.
Figure 2E:
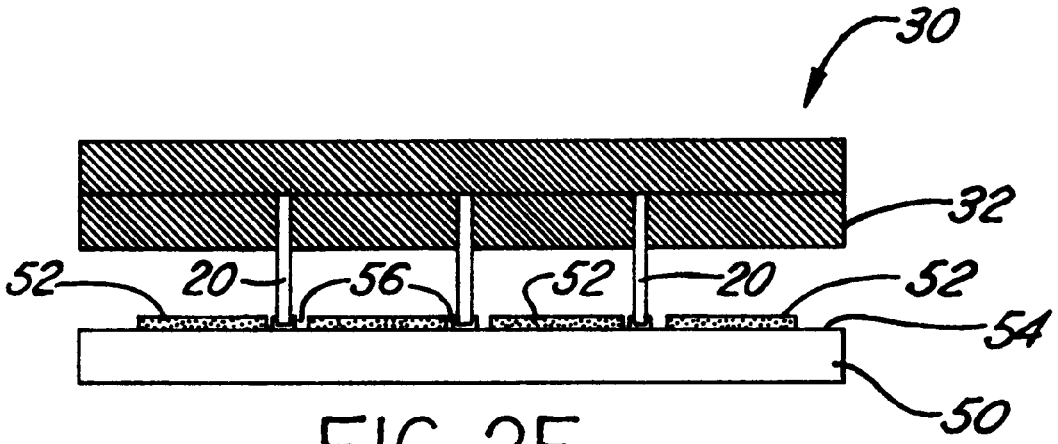
FIG. 2E is a cross-sectional view of the present invention spacers and lower glass panel of FIG. 2D after the spacers are pressed onto the lower glass panel in the spacings between the active regions.
Figure 2F:
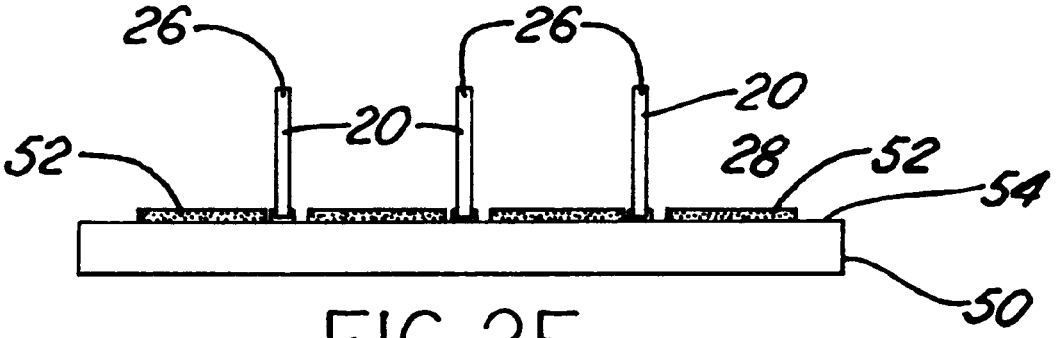
FIG. 2F is a cross-sectional view of the present invention spacers of FIG. 2E after the spacers are bonded to a lower glass panel by the adhesive coating provided on the spacers.

In the next step of the present invention method for bonding elongated spacers to a lower glass panel for a vacuum display device, as shown in FIG. 2D, the holding fixture 30 is positioned over a lower glass panel 50. It is noted that on a top surface 54 of the lower glass panel 50, a multiplicity of active regions 52, or electron emission areas, are provided. Each of the active regions, or electron emission areas is also known as a pixel. A suitable spacing 56 formed between the active regions 52 is in the range of between about 50 μm and about 200 μm which are predetermined when the vacuum display device is designed. A frequently used spacing is about 100 μm. A suitable aspect ratio for width/height of the elongated spacers 20 is between about ⅕ and about 1/20. For instance, the elongated spacers 20 may have a width (or thickness) of between about 30 μm and about 150 μm and a height in the range between about 0.5 mm and about 3 mm. A typical elongated spacer 20 for FED may have a width of 50 μm~100 μm and a height of about 1 mm.

It is evident, that at a maximum spacing of 200 μm provided between the active regions 52, and a maximum width (or thickness) of 150 μm for the spacer 20, a maximum coating thickness of about 40 μm may be allowed on both sides of the spacer 20 for FED application such that the adhesive does not touch or contaminate the active regions 52. FIG. 2E illustrates the contact made between the bottom ends 28 of the spacers 20 with the spacings 56 between the active regions 52 formed on the lower glass plate 50. As shown in FIG. 2E, the adhesive 40 does not touch or contaminate the active regions 52, and therefore illustrating an ideal bonding result.

In the last step of the present invention novel bonding process, the holding fixture 30 for the spacers 20 is removed leaving the spacers 20 bonded to the lower glass plate 50. This is shown in FIG. 2F.

The present invention novel method may optionally include an annealing step for the adhesive material. Prior to the removal of the holding fixture 30 from the spacers 20, as shown in FIG. 2E, the complete assembly of the holding fixture 30, the spacers 20 and the lower glass plate 50 may be placed in an oven, or on a conveyor belt through an oven, for exposure to an annealing temperature between about 250° C. and about 600° C., depending on the type of adhesive material used. The annealing step is optionally since certain types of adhesive materials may not require the annealing process for achieving a suitable bond between the spacers 20 and the lower glass plate 50. The annealing process, however, not only improves the bonding between the two members, but also serves as a stress relief function and produces a structure of higher reliability.

Figure 3A:
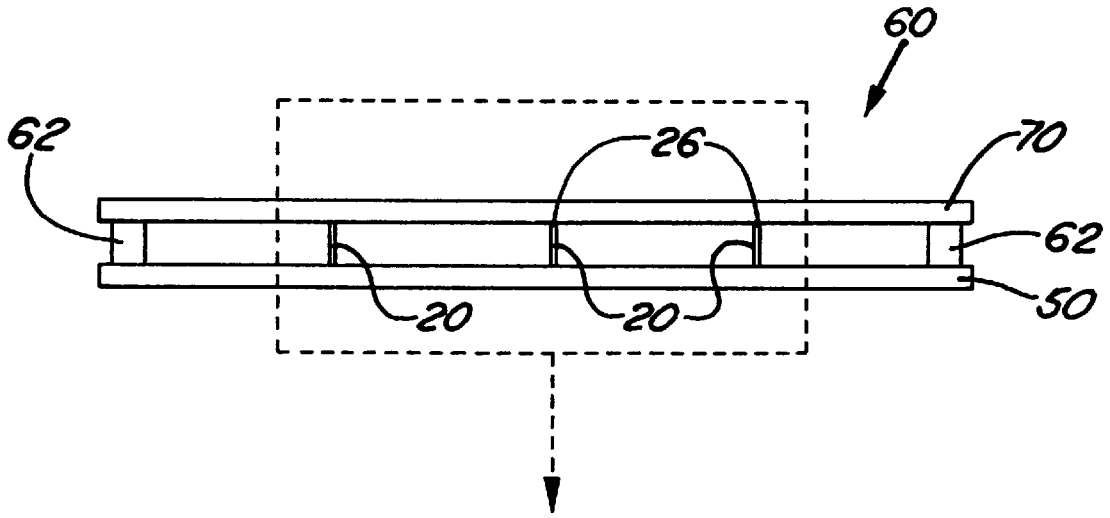
FIG. 3A is a cross-sectional view of a present invention vacuum display device with the elongated spacers mounted therein.
Figure 3B:
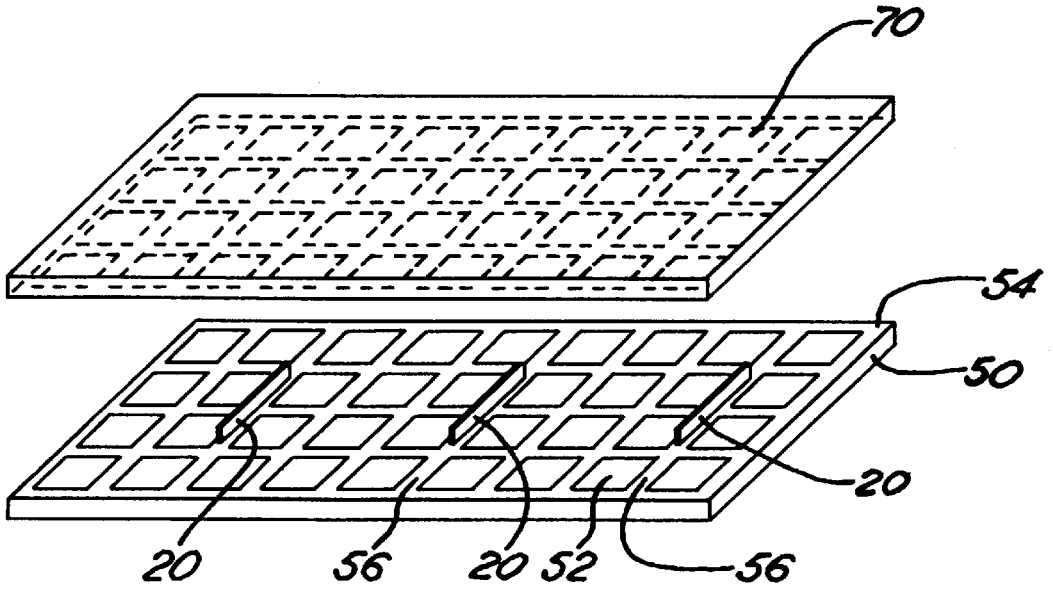
FIG. 3B is a perspective view of the present invention vacuum display panel of FIG. 3A with the top glass panel suspended over the lower glass panel.

FIGS. 3A and 3B illustrate a completed structure by utilizing the present invention novel method. For instance, FIG. 3A is a cross-sectional view illustrating a vacuum display device 60 formed by the present invention novel method. The vacuum display device 60 is formed by bonding an upper glass plate 70 to the top edges 26 of the spacers 20 and to four sidewall panels 62 positioned at the peripheral edged of the vacuum display device 60. The bonding process may be advantageously performed by using similar types of adhesive materials that previously described. A perspective view of the vacuum display device 60 with the top glass plate 70 suspended over the lower glass plate 50 is shown in FIG. 3B. The top plate 70 is shown separated from the lower plate 50 for clarity reason such that the position of the elongated spacers 20 can be easily seen after bonding to the spacings 56 provided on the top surface 54 of the lower plate 50. It should further be noted that depending on the structural requirement, the spacing between the two glass panels, the total number of spacers 20 utilized and their positions may be suitably adjusted.

The present invention novel method for forming a vacuum display device with elongated spacers positioned therein and the structures formed have therefore been described in the above descriptions and in the appended drawings of FIGS. 2A~3B.

While the present invention has been described in an illustrative manner, it should be understood that the terminology used is intended to be in a nature of words of description rather than of limitation.

Furthermore, while the present invention has been described in terms of a preferred embodiment, it is to be appreciated that those skilled in the art will readily apply these teachings to other possible variations of the inventions.

The embodiment of the invention in which an exclusive property or privilege is claimed are defined as follows:

What is claimed is:

1. A method for forming a vacuum chamber comprising the steps of:

providing an upper glass panel and a lower glass panel, providing at least two spacers in elongated shape with their upper ends removably clamped in a clamping fixture such that each of said spacers extends perpendicularly away from said clamping fixture at a predetermined distance from its immediately adjacent spacers, pressing said clamping fixture into and removing the same from a layer of adhesive such that the lower ends of each of said at least two spacers being coated with said adhesive, pressing said clamping fixture onto a top surface of said lower glass panel such that each of said lower ends of said at least two spacers intimately contacts said top surface of the lower glass panel, heating said clamping device, said at least two spacers and said lower glass panel to a temperature and for a time period sufficient to form an adhesive bond between said lower ends of said at least two spacers and said top surface of the lower glass panel, removing said clamping fixture from said upper ends of said at least two spacers, and mounting said upper glass panel to upper ends of said at least two spacers.

2. A method for forming a vacuum chamber according to claim 1, wherein said at least two spacers of elongated shape have an aspect ratio of width/height of at least ⅕.

3. A method for forming a vacuum chamber according to claim 1, wherein said at least two spacers are in elongated shape having an aspect ratio of width/height of between about ⅕ and about 1/20.

4. A method for forming a vacuum chamber according to claim 1 further comprising the step of heating said clamping device, said at least two spacers and said lower glass panel to a temperature of at least 250° C.

5. A method for forming a vacuum chamber according to claim 1 further comprising the step of heating said clamping device, said at least two spacers and said lower glass panel to a temperature of between about 250° C. and about 600°.

6. A method for forming a vacuum chamber according to claim 1, wherein said lower glass panel being provided with active regions that have a predetermined space thereinbetween for the mounting of said at least two spacers.

7. A method for forming a vacuum chamber according to claim 1 further comprising the step of bonding said upper glass panel to said upper ends of said at least two spacers.

8. A method for forming a vacuum chamber according to claim 1 further comprising the step of mounting said upper glass panel to said at least two spacers and four sidewalls between said upper and lower glass panels forming a sealed chamber.

9. A method for fabricating a vacuum display device with spacers between active regions comprising the steps of:

providing a first glass panel having a multiplicity of active regions formed on a top surface, said multiplicity of active regions being arranged in a spaced-apart, matrix configuration having pre-set spacings thereinbetween, providing a plurality of spacers in elongates shape each having a top edge and a bottom edge parallel to said top edge, mounting said plurality of spacers in a holding fixture with said top edges of said spacers releasably clamped in said fixture and said bottom edges substantially exposed, pressing said holding fixture with said plurality of spacers clamped therein against a layer of adhesive until said bottom edges of the spacers are coated with said adhesive, pressing said holding fixture onto said top surface of said first glass panel until the bottom edges of said spacers are bonded to said top surface in said pre-set spacings and removing said holding fixture, and mounting a second glass panel onto said bottom edges of said plurality of spacers forming a vacuum display device.

10. A method for fabricating a vacuum display device with spacers between active regions according to claim 9 further comprising the step of providing said layer of adhesive in a dielectric material.

11. A method for fabricating a vacuum display device with spacers between active regions according to claim 9 further comprising the step of providing said layer of adhesive in an electrically insulating material that survives a service temperature of 600° C.

12. A method for fabricating a vacuum display device with spacers between active regions according to claim 9 further comprising the step of providing said layer of adhesive in a material selected from the group consisting of oxide pastes and glass fritz.

13. A method for fabricating a vacuum display device with spacers between active regions according to claim 9 further comprising the step of providing said layer of adhesive material by a screen printing technique in a pattern corresponding to a pattern of placement for said plurality of spacers.

14. A method for fabricating a vacuum display device with spacers between active regions according to claim 9 further comprising the step of providing said layer of adhesive material by a spin coating technique until a pre-set thickness of the adhesive is achieved.

15. A method for fabricating a vacuum display device with spacers between active regions according to claim 9, wherein said holding fixture is a mechanical clamping device.

16. A method for fabricating a vacuum display device with spacers between active regions according to claim 9 further comprising the step of providing a first glass panel having a multiplicity of pixels formed thereon, aid multiplicity of pixels being electrically insulated from each other in a spaced-apart relationship with a pre-set spacing thereinbetween.

17. A method for fabricating a vacuum display device with spacers between active regions according to claim 9, wherein said pre-set spacings being in the range between about 50 $\mu$m and about 200 $\mu$m.

18. A method for fabricating a vacuum display device with spacers between active regions according to claim 9, wherein said layer of adhesive has a sufficient thickness such that said bottom edges of the spacers are coated with said adhesive to a thickness between about 5 $\mu$m and about 40 $\mu$m.

19. A method for fabricating a vacuum display device with spacers between active regions according to claim 9, wherein said plurality of spacers having a width/height aspect ratio of between about 1/5 and about 1/20.

20. A method for fabricating a vacuum display device with spacers between active regions according to claim 9, wherein said plurality of spacers having a height between about 5 $\mu$mm and about 3 mm.

21. A method for fabricating a vacuum display device with spacers between active regions according to claim 9 further comprising the step of heating said holding fixture, said plurality of spacers and said first glass panel to a temperature sufficient to form a bond between said bottom edges of said plurality of spacers and said top surface of the first glass panel.

22. A method for fabricating a vacuum display device with spacers between active regions according to claim 9 further comprising the step of heating said holding fixture, said plurality of spacers and said first glass panel to a temperature sufficient to form a bond between said bottom edges of said plurality of spacers and said top surface of the first glass panel.

23. A method for fabricating a vacuum display device with spacers between active regions according to claim 9 further comprising the step of heating said holding fixture, said plurality of spacers and said first glass panel to a temperature between about 250° C. and about 600° C.

24. A method for fabricating a vacuum display device with spacers between active regions according to claim 9 further comprising the step of bonding a second glass panel onto said bottom edges of said plurality of spacers and four sidewall panels forming a vacuum tight chamber.

* * * * *